US011059690B2

(12) United States Patent
Harrington et al.

(10) Patent No.: US 11,059,690 B2
(45) Date of Patent: Jul. 13, 2021

(54) METHOD AND SYSTEM FOR AUTOMATED STACKING AND LOADING OF WRAPPED FACEMASKS INTO A CARTON IN A MANUFACTURING LINE

(71) Applicant: O&M Halyard, Inc., Mechanicsville, VA (US)

(72) Inventors: David Lamar Harrington, Cumming, GA (US); Mark Thomas Pamperin, Cumming, GA (US); Nathan Craig Harris, Canton, GA (US); Joseph P. Weber, Suwanee, GA (US); Ajay Y. Houde, Johns Creek, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 460 days.

(21) Appl. No.: 15/768,182

(22) PCT Filed: Oct. 16, 2015

(86) PCT No.: PCT/US2015/055882
§ 371 (c)(1),
(2) Date: Apr. 13, 2018

(87) PCT Pub. No.: WO2017/065794
PCT Pub. Date: Apr. 20, 2017

(65) Prior Publication Data
US 2020/0189777 A1 Jun. 18, 2020

(51) Int. Cl.
*B65H 31/32* (2006.01)
*B65B 35/32* (2006.01)
*B65B 35/50* (2006.01)

(52) U.S. Cl.
CPC ..... *B65H 31/32* (2013.01); *B65B 35/32* (2013.01); *B65B 35/50* (2013.01)

(58) Field of Classification Search
CPC ..... B65H 31/32; B65H 33/16; B65H 31/10; B65H 2301/42112; B65H 33/18;
(Continued)

(56) References Cited

U.S. PATENT DOCUMENTS 2,354,294 A 7/1944 Schimmel
3,123,125 A 3/1964 Lacey, Jr.
(Continued)

FOREIGN PATENT DOCUMENTS

CA 828007 A 11/1969
CA 2 325 975 A1 5/2002
(Continued)

OTHER PUBLICATIONS

International Search Report and Written Opinion for PCT/US2015/055882, dated Jun. 27, 2016, 14 pages.

*Primary Examiner* — Gregory W Adams
(74) *Attorney, Agent, or Firm* — Dority & Manning. P.A.

(57) ABSTRACT

An automated method and system for stacking and loading wrapped or unwrapped facemasks into a carton in a facemask production line includes conveying individual wrapped facemasks in a continuous stream to a stacking location. At the stacking location, the facemasks are deposited into a vertical accumulator such that the facemasks are stacked in the accumulator. Upon reaching a predetermined fill level of facemasks in the accumulator, a bottom retainer in the accumulator is opened such that the stacked facemasks drop into a carton placed below the accumulator. Upon opening the bottom retainer, a mid-level retainer is actuated in the accumulator that captures facemasks that continue to be deposited into the accumulator at an intermediate height above the bottom retainer. The bottom retainer is closed after the stacked facemasks drop into the carton, and the mid-level retainer is then opened such that
(Continued)

the facemasks captured by the mid-level retainer drop onto the bottom retainer.

10 Claims, 5 Drawing Sheets

(58) Field of Classification Search
CPC . B65H 31/3009; Y10S 414/115; B65B 35/50; B65B 5/068; B65B 5/06; B65G 57/03; B65G 57/06
See application file for complete search history.

(56) References Cited

U.S. PATENT DOCUMENTS

| | | | | |
|---|---|---|---|---|
| 3,205,794 | A * | 9/1965 | Califano | B65H 33/16 414/789.1 |
| 3,242,783 | A | 3/1966 | Schmermund | |
| 3,670,474 | A | 6/1972 | Vieson et al. | |
| 3,800,640 | A | 4/1974 | Barrie | |
| 3,847,046 | A | 11/1974 | Schmermund | |
| 3,926,097 | A | 12/1975 | Santa Maria et al. | |
| 3,958,390 | A | 5/1976 | Pringle, Jr. et al. | |
| 3,960,096 | A * | 6/1976 | Zobel | D05B 33/02 112/470.02 |
| 3,971,369 | A | 7/1976 | Aspelin et al. | |
| 3,983,774 | A | 10/1976 | Seragnoli | |
| 4,111,411 | A * | 9/1978 | Graves | B65H 29/6618 198/577 |
| 4,261,457 | A | 4/1981 | van Maanen | |
| 4,269,315 | A | 5/1981 | Boyce | |
| 4,440,289 | A | 4/1984 | Weis | |
| 4,467,589 | A | 8/1984 | van Maanen | |
| 4,525,977 | A | 7/1985 | Matt | |
| 4,543,152 | A | 9/1985 | Nozaka | |
| 4,549,386 | A | 10/1985 | Wilson | |
| 4,550,856 | A | 11/1985 | Ballmann et al. | |
| 4,630,310 | A | 12/1986 | Winesett | |
| 4,662,005 | A | 5/1987 | Grier-Idris | |
| 4,722,168 | A | 2/1988 | Heaney | |
| 4,788,812 | A * | 12/1988 | Morita | B65B 35/50 53/447 |
| 4,809,481 | A | 3/1989 | Früh et al. | |
| 5,079,902 | A | 1/1992 | Seko et al. | |
| 5,117,614 | A | 6/1992 | Johnsen | |
| 5,155,967 | A | 10/1992 | Branson | |
| 5,170,610 | A * | 12/1992 | Tisma | B65G 17/36 53/447 |
| 5,255,584 | A * | 10/1993 | Fakler | B65B 35/50 414/790 |
| 5,322,061 | A | 6/1994 | Brunson | |
| 5,548,946 | A | 8/1996 | Holub | |
| 5,615,767 | A | 4/1997 | Eull et al. | |
| 5,724,677 | A | 3/1998 | Bryant et al. | |
| 5,727,369 | A | 3/1998 | Mosse | |
| 5,921,375 | A | 7/1999 | Van Laar | |
| 6,098,785 | A | 8/2000 | Van Maanen | |
| 6,117,515 | A | 9/2000 | Brunson et al. | |
| 6,122,898 | A | 9/2000 | De Kort | |
| 6,123,077 | A | 9/2000 | Bostock et al. | |
| 6,125,849 | A | 10/2000 | Williams et al. | |
| 6,173,712 | B1 | 1/2001 | Brunson | |
| 6,174,397 | B1 | 1/2001 | Johnson | |
| 6,394,090 | B1 | 5/2002 | Chen et al. | |
| 6,524,423 | B1 | 2/2003 | Hilt et al. | |
| 6,729,103 | B1 | 5/2004 | Hartness et al. | |
| 6,868,984 | B2 | 3/2005 | Griesbach, III et al. | |
| 6,886,563 | B2 | 5/2005 | Bostock et al. | |
| 7,052,006 | B2 * | 5/2006 | Stauber | B65H 33/04 270/58.31 |
| 7,125,216 | B2 * | 10/2006 | Grewe | B26D 7/0675 414/790.8 |
| 7,703,260 | B1 | 4/2010 | Watkins | |
| 8,061,356 | B2 | 11/2011 | Bowen | |
| 8,061,960 | B2 * | 11/2011 | Hopwood | B65G 47/848 414/795.8 |
| 8,700,214 | B2 | 4/2014 | Fortman | |
| 9,126,348 | B2 * | 9/2015 | Meyer | B26D 7/0675 |
| 9,150,382 | B2 * | 10/2015 | Allen | B65H 31/3009 |
| 10,227,202 | B2 | 3/2019 | Pamperin et al. | |
| 10,492,547 | B2 | 12/2019 | Weber et al. | |
| 2002/0095913 | A1 | 7/2002 | Honegger | |
| 2003/0000805 | A1 | 1/2003 | Wild et al. | |
| 2003/0010422 | A1 | 1/2003 | Starkey | |
| 2004/0121107 | A1 | 6/2004 | Bell et al. | |
| 2004/0144619 | A1 | 7/2004 | Ohiro et al. | |
| 2004/0262127 | A1 | 12/2004 | Harnish et al. | |
| 2005/0166733 | A1 | 8/2005 | Piscitello | |
| 2006/0070353 | A1 | 4/2006 | Van Dam | |
| 2006/0096003 | A1 | 5/2006 | Plaatje et al. | |
| 2008/0008509 | A1 * | 1/2008 | Hamers | B65H 31/3018 399/405 |
| 2008/0072721 | A1 | 3/2008 | Kern | |
| 2008/0251210 | A1 | 10/2008 | Chen | |

FOREIGN PATENT DOCUMENTS

| | | | | |
|---|---|---|---|---|
| CN | 104872866 | A | 9/2015 | |
| CN | 104939377 | A | 9/2015 | |
| DE | 3736868 | A1 | 5/1989 | |
| EP | 0 257 852 | A2 | 3/1988 | |
| EP | 0 622 298 | A1 | 11/1994 | |
| EP | 0 640 526 | A1 | 3/1995 | |
| EP | 0 791 537 | A1 | 8/1997 | |
| EP | 0 806 343 | A2 | 11/1997 | |
| EP | 0 894 752 | A1 | 2/1999 | |
| EP | 1 048 595 | A1 | 11/2000 | |
| EP | 1 757 552 | A2 | 2/2007 | |
| EP | 1 840 033 | A2 | 10/2007 | |
| EP | 2 484 611 | A2 | 8/2012 | |
| EP | 2 757 062 | A1 | 7/2014 | |
| EP | 2 801 790 | A1 | 11/2014 | |
| FR | 1.588.621 | | 4/1970 | |
| GB | 364557 | | 12/1931 | |
| GB | 1 216 310 | | 12/1970 | |
| GB | 1 232 053 | | 5/1971 | |
| GB | 1 361 496 | | 7/1974 | |
| GB | 2 092 090 | A | 8/1982 | |
| GB | 2436728 | A * | 10/2007 | B65G 57/06 |
| JP | S 62103536 | U | 7/1987 | |
| JP | H04311405 | A | 11/1992 | |
| JP | H05-78007 | A | 3/1993 | |
| JP | H05170209 | A | 7/1993 | |
| JP | H06211214 | A | 8/1994 | |
| JP | 2000198600 | A | 7/2000 | |
| JP | 2002052487 | A | 2/2002 | |
| JP | 2005272512 | A | 10/2005 | |
| JP | 2006206085 | A * | 8/2006 | |
| JP | 2007084309 | A | 4/2007 | |
| JP | 2008055035 | A | 3/2008 | |
| JP | 2009286490 | A | 12/2009 | |
| JP | 2011178459 | A | 9/2011 | |
| JP | 2011200510 | A | 10/2011 | |
| JP | 2012201409 | A | 10/2012 | |
| JP | 2013230380 | A | 11/2013 | |
| KR | 100550225 | B1 | 2/2006 | |
| WO | WO 97/32494 | | 9/1997 | |
| WO | WO 99/24119 | A1 | 5/1999 | |
| WO | WO 02/28760 | A1 | 4/2002 | |
| WO | WO 2005/054106 | A1 | 6/2005 | |

* cited by examiner

-Prior Art-

-Prior Art-

METHOD AND SYSTEM FOR AUTOMATED STACKING AND LOADING OF WRAPPED FACEMASKS INTO A CARTON IN A MANUFACTURING LINE

FIELD OF THE INVENTION

The present invention relates generally to the field of protective facemasks, and more specifically to a method and related system for stacking and packaging wrapped facemask in the manufacturing line of such facemasks.

FAMILY OF RELATED APPLICATIONS

The present application is related by subject matter to the following concurrently filed PCT applications (all of which designate the US):

a. International Application No.: PCT/US2015/055858; entitled "Method and System for Splicing Nose Wire in a Facemask Manufacturing Process".

b. International Application No.: PCT/US2015/055861; entitled "Method and System for Splicing Nose Wire in a Facemask Manufacturing Process".

c. International Application No.: PCT/US2015/055863; entitled "Method and System for Introducing a Reserve Nose Wire in a Facemask Production Line".

d. International Application No.: PCT/U S2015/055865; entitled "Method and System for Cutting and Placing Nose Wires in a Facemask Manufacturing Process".

e. International Application No.: PCT/US2015/055867; entitled "Method and System for Placing Nose Wires in a Facemask Manufacturing Process".

f. International Application No.: PCT/US2015/055871; entitled "Method and System for Placing Nose Wires in a Facemask Manufacturing Process".

g. International Application No.: PCT/US2015/055872; entitled "Method and System for Placing Nose Wires in a Facemask Manufacturing Process".

h. International Application No.: PCT/US2015/055876; entitled "Method and System for Wrapping and Preparing Facemasks for Packaging in a Manufacturing Line".

i. International Application No.: PCT/US2015/055878; entitled "Method and System for Automated Stacking and Loading of Wrapped Facemasks into a Carton in a Facemask Manufacturing Line".

The above cited applications are incorporated herein by reference for all purposes. Any combination of the features and aspects of the subject matter described in the cited applications may be combined with embodiments of the present application to yield still further embodiments of the present invention.

BACKGROUND OF THE INVENTION

Various configurations of disposable filtering facemasks or respirators are known and may be referred to by various names, including "facemasks", "respirators", "filtering face respirators", and so forth. For purposes of this disclosure, such devices are referred to generically as "facemasks."

The ability to supply aid workers, rescue personnel, and the general populace with protective facemasks during times of natural disasters or other catastrophic events is crucial. For example, in the event of a pandemic, the use of facemasks that offer filtered breathing is a key aspect of the response and recovery to such event. For this reason, governments and other municipalities generally maintain a ready stockpile of the facemasks for immediate emergency use. However, the facemasks have a defined shelf life, and the stockpile must be continuously monitored for expiration and replenishing. This is an extremely expensive undertaking.

Recently, investigation has been initiated into whether or not it would be feasible to mass produce facemasks on an "as needed" basis during pandemics or other disasters instead of relying on stockpiles. For example, in 2013, the Biomedical Advanced Research and Development Authority (BARDA) within the Office of the Assistant Secretary for Preparedness and Response in the U.S. Department of Health and Human Services estimated that up to 100 million facemasks would be needed during a pandemic situation in the U.S., and proposed research into whether this demand could be met by mass production of from 1.5 to 2 million facemasks per day to avoid stockpiling. This translates to about 1,500 masks/minute. Current facemask production lines are capable of producing only about 100 masks/minute due to technology and equipment restraints, which falls far short of the estimated goal. Accordingly, advancements in the manufacturing and production processes will be needed if the goal of "on demand" facemasks during a pandemic is to become a reality.

In conventional facemask production lines, once the facemasks have been cut and wrapped, manual labor is necessary to align, stack, and place the masks in a carton. These manual steps are a significant impediment to mass production of the facemasks at the throughputs mentioned above.

The present invention addresses this need and provides a method and system for high speed aligning and stacking of wrapped facemasks into a carton for further high speed packaging.

SUMMARY OF THE INVENTION

Objects and advantages of the invention will be set forth in the following description, or may be obvious from the description, or may be learned through practice of the invention.

In accordance with aspects of the invention, an automated method is provided for stacking and loading wrapped or unwrapped facemasks into a carton in a facemask production line. The method includes conveying individual wrapped or unwrapped facemasks in a continuous stream to a stacking location. At the stacking location, the facemasks are deposited into a vertical accumulator such that the facemasks are stacked in the accumulator. Upon reaching a predetermined fill level of facemasks in the accumulator, a bottom retainer in the accumulator is opened such that the stacked facemasks drop into a carton placed below the accumulator. The bottom retainer may be a floor of the accumulator, tabs or flaps at an open bottom end of the accumulator, and so forth. Upon opening the bottom retainer, a mid-level retainer in the accumulator is actuated to project into the accumulator and capture facemasks that continue to be deposited into the accumulator while the bottom retainer is open at an intermediate height above the bottom retainer. The mid-level retainer may be flaps or a gate within the accumulator that swing from a vertical position to a horizontal position when actuated. The bottom retainer is closed after the stacked facemasks drop into the carton. The mid-level retainer is then opened such that the facemasks captured by the mid-level retainer drop onto the bottom retainer.

The method may further include staging a second carton below the accumulator after the bottom retainer has closed, wherein the process is repeated in a continuous manner.

The facemasks may be brought to the stacking location and deposited into the accumulator by various conveying means. In one embodiment, a linear conveyor conveys the continuous stream of facemasks at a transport speed to the stacking location. This transport speed, however, may be too great for depositing the facemasks into the accumulator without causing damage to the wrapped facemasks (including cosmetic damage to the wrapping material) resulting from the facemasks hitting the accumulator wall. The method may include using controllable feed rollers that "grab" the facemasks from the linear conveyor and decelerate the articles to a slower speed prior to facemasks dropping into the accumulator.

In an alternate embodiment, the facemasks may be brought to the stacking location by a rotary conveyor, wherein the facemasks are held to the conveyor by vacuum and dropped into the accumulator at deposit position of the rotary conveyor.

It may be desired that the facemasks have an alternating stack pattern in the carton. Thus, the method includes depositing the facemasks into the accumulator in an alternating configuration. For this, the facemasks may be oriented on the conveyor prior to reaching the stacking location, for example by a vacuum puck placer or other article moving device.

The present method provides increased versatility in that different carton sizes and load requirements can be met by changing the predetermined fill level of facemasks in the accumulator to accommodate the different carton sizes.

The present invention also encompasses various system embodiments for automated stacking and loading facemasks in a facemask production line in accordance with the present methods, as described and supported herein.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

As mentioned, the present methods relate to stacking and loading individually wrapped facemasks into a carton in an automated production line. The current methods will reduce the time spent on these processes as compared to current production lines, and thus contribute to achieving the production throughputs necessary for on-demand facemasks during extreme situations (e.g., a pandemic or natural disaster). It should be appreciated that that the upstream production steps for forming and wrapping the individual facemasks are not limiting aspects of the invention and, thus, will not be explained in great detail herein.

Also, the present disclosure refers to or implies conveyance or transport of certain components of the facemasks through the production line. It should be readily appreciated that any manner and combination of article conveyors (e.g., rotary and linear conveyors), article placers (e.g. vacuum puck placers), and transfer devices are well known in the article conveying industry and can be used for the purposes described herein. It is not necessary for an understanding and appreciation of the present methods to provide a detailed explanation of these well-known devices and system.

Various styles and configurations of facemasks, including generally trapezoidal cone masks and flat pleated facemasks are well-known, and the present methods may have utility in the production lines for these conventional masks. For illustrative purposes only, aspects of the present method are described herein with reference to a particular type of trapezoidal respirator facemask often referred to in the art as a "duckbill" mask, as illustrated in FIG. 1.

Figure 1:
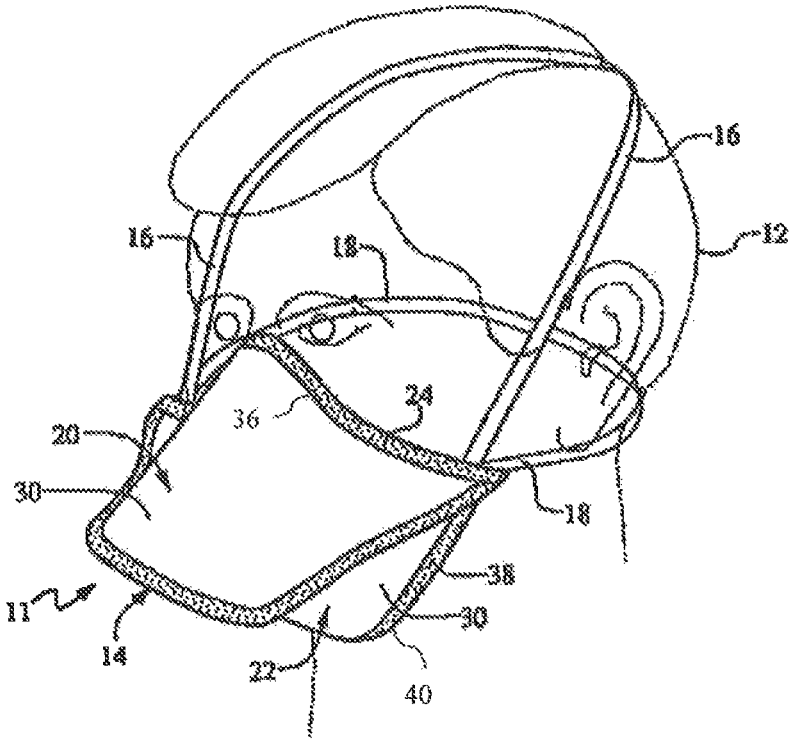
FIG. 1 is a perspective view of a conventional respiratory facemask worn by a user, the facemask incorporating a nose wire to conform the facemask to the user's face.
Figure 2:
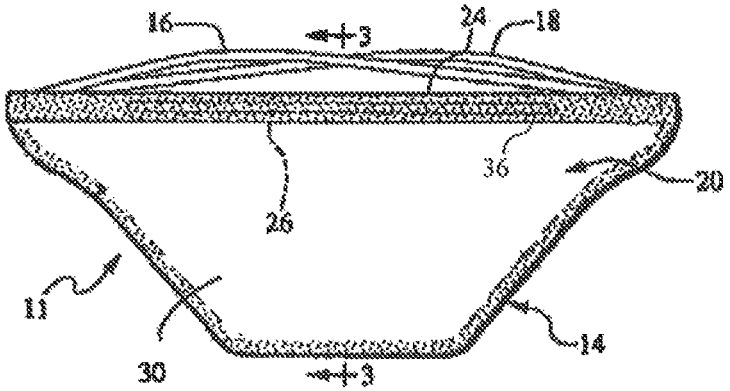
FIG. 2 is a top view of the conventional facemask of FIG. 1 is a folded state.

Referring to FIGS. 1 and 2, a representative facemask 11 (e.g., a duckbill facemask) is illustrated on the face of wearer 12. The mask 11 includes filter body 14 that is secured to the wearer 12 by means of resilient and elastic straps or securing members 16 and 18. The filter body 14 includes an upper portion 20 and a lower portion 22, both of which have complimentary trapezoidal shapes and are preferably bonded together such as by heat and/or ultrasonic sealing along three sides. Bonding in this manner adds important structural integrity to mask 11.

The fourth side of the mask 11 is open and includes a top edge 24 and a bottom edge 38, which cooperate with each other to define the periphery of the mask 11 that contacts the wearer's face. The top edge 24 is arranged to receive an elongated malleable member 26 (FIG. 2) in the form of a flat metal ribbon or wire (referred to herein as a "nose wire"). The nose wire 26 is provided so that top edge 24 of mask 11 can be configured to closely fit the contours of the nose and cheeks of wearer 12. The nose wire 26 is typically constructed from an aluminum strip with a rectangular cross-section. With the exception of having the nose wire 26 located along top edge 24 of the upper portion 20 of the mask 11, the upper and lower portions 20 and 22 may be identical.

As shown in FIG. 1, the mask 11 has the general shape of a cup or cone when placed on the face of wearer 12 and thus provides "off-the-face" benefits of a molded-cone style mask while still being easy for wearer 12 to carry mask 11 in a pocket prior to use. "Off-the-face" style masks provide a larger breathing chamber as compared to soft, pleated masks which contact a substantial portion of the wearer's face. Therefore, "off-the-face" masks permit cooler and easier breathing.

Blow-by associated with normal breathing of wearer 12 is substantially eliminated by properly selecting the dimension and location of the nose wire 26 with respect to top edge of 24. The nose wire 26 is preferably positioned in the center of top edge 24 and has a length in the range of fifty percent (50%) to seventy percent (70%) of the total length of the top edge 24.

The upper and lower portions 20 and 22 may include multiple layers and each have an outer mask layer 30 and inner mask layer. Located between the outer and inner mask layers are one or more intermediate filtration layers that are typically constructed from a melt-blown polypropylene, extruded polycarbonate, melt-blown polyester, or a melt-blown urethane.

The top edge 24 of the mask 11 is faced with an edge binder 36 that extends across the open end of mask 11 and covers the nose wire 26. Similarly, the bottom edge 38 is encompassed by an edge binder 40. Edge binders 36 and 40 are folded over and bonded to the respective edges 24, 38 after placement of the nose wire 26 along the top edge 24. The edge binders 36, 40 may be constructed from a spun-laced polyester material.

Figure 3:
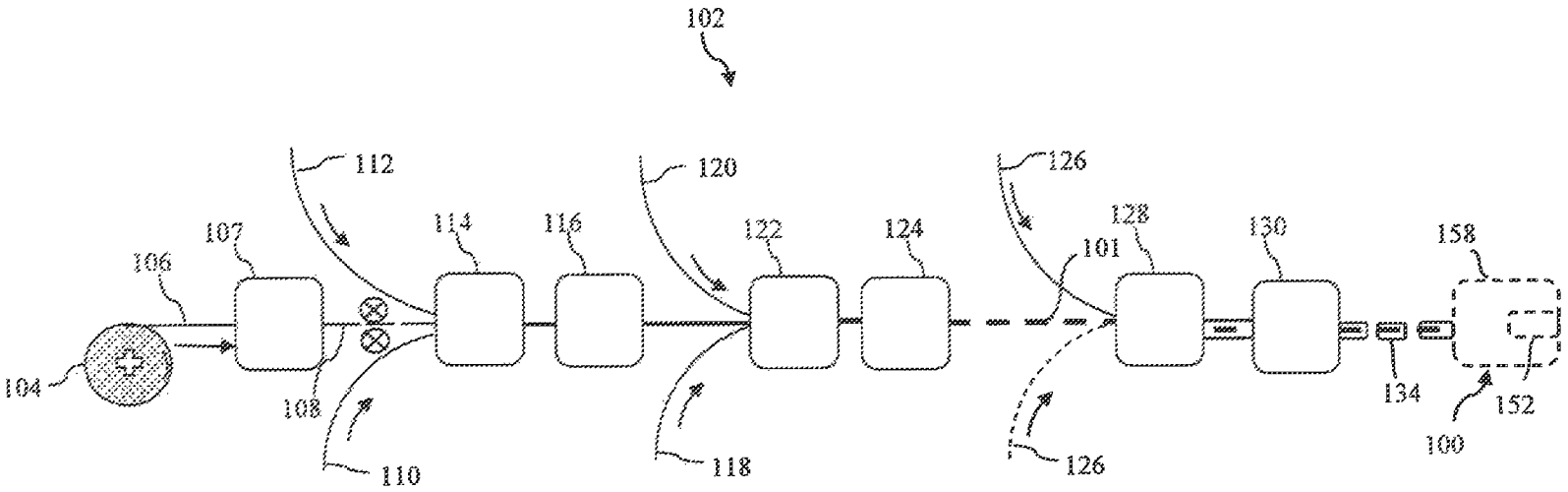
FIG. 3 is a schematic representation of facemask production line in which embodiments of the present method may be incorporated.

FIG. 3 depicts portions of a generic production line 102 for automated, in-line production of individual facemasks. It should be appreciated that the various processes, equipment, controls, etc., can vary greatly between different production lines 102, and that FIG. 3 is presented for illustrative purposes only. The methods described herein will have utility in many different types of production lines 102.

FIG. 3 represents a production line 102 wherein nose wires are incorporated into an edge of the facemasks. A running nose wire 106 is supplied in continuous strip form from a source, such as a driven spool or roll 104, to a cutting station 107 wherein the wire 106 is cut into individual nose wires 108 having a defined length. Suitable cutting stations 108 are known and used in conventional production lines.

The nose wires 108 are conveyed onto a carrier web 110, which, referring to FIG. 2, may be the continuous multi-layer web that defines the upper body portion 20 of the finished face mask 11. The individual nose wires 108 are deposited along the edge of the carrier web 110 corresponding to the top edge 24 of the facemask 11 in FIG. 2.

After placement of the individual nose wires 108 in position on the carrier web 110, a binder web 112 is introduced to the production line 102 along both edges of the carrier web 110 (only one binder web 112 is depicted in FIG. 3.). The combination of carrier web 110, nose wire 108, and binder webs 112 pass through a folding station 114 wherein the binder webs 112 are folded around the respective running edges of the carrier web 110. The components then pass through a bonding station 116 wherein the binder webs 112 are thermally bonded to the carrier web 110, thereby producing the edge configurations 24, 38 depicted in FIGS. 1 and 2. The nose wire 108 is essentially encapsulated along the top edge 24 by the binder web 112.

From the bonding station 116, the continuous combination of carrier web 110 with nose wires 108 encapsulated in the binder 112 is conveyed to another bonding station 122. At this station, an additional web 118 is introduced that corresponds to the lower panel portion 22 of the face mask 11 depicted in FIGS. 1 and 2. This web 118 may already have the binder web applied to the edge thereof from an upstream process. Continuous elastomeric straps 120 are also introduced and are laid between the edges of the web 118 and web 110 corresponding to the edges 24, 28 in FIG. 1. The materials are bonded together in a bond pattern that corresponds to the trapezoidal shape of the facemask 11 with a closed end and an open end at the edges 24, 28.

The bonded webs 110 and 118 (with nose wires and straps) are conveyed to a cutting station 124 wherein the individual facemasks 101 are cut out from the webs along the bond lines.

The facemasks 101 are then conveyed to a bonding station 128 wherein wrapping materials 126 (e.g. a poly material) are introduced and are folded (if necessary) and bonded around the individual facemasks 101. A single web of the wrapping material 126 may be folded around the facemasks and sealed along a continuous longitudinal bond line or, in an alternate embodiment depicted by the dashed line in FIG. 3, an additional web of the wrapping material 126 may be introduced to the bonding station, wherein the facemasks are sandwiched between the two webs 126. The webs 126 are then sealed along continuous longitudinal bond lines along their mating edges.

A continuous stream of wrapped facemasks 132 emerge from the bonding station 128 and are conveyed to a cutting station 130 wherein cuts are made in the bonded wrapping material in a desired pattern to produce individual wrapped facemasks 134. These masks 134 are conveyed to downstream processing stations 136 for further processing, including stacking and packaging.

Figure 4:
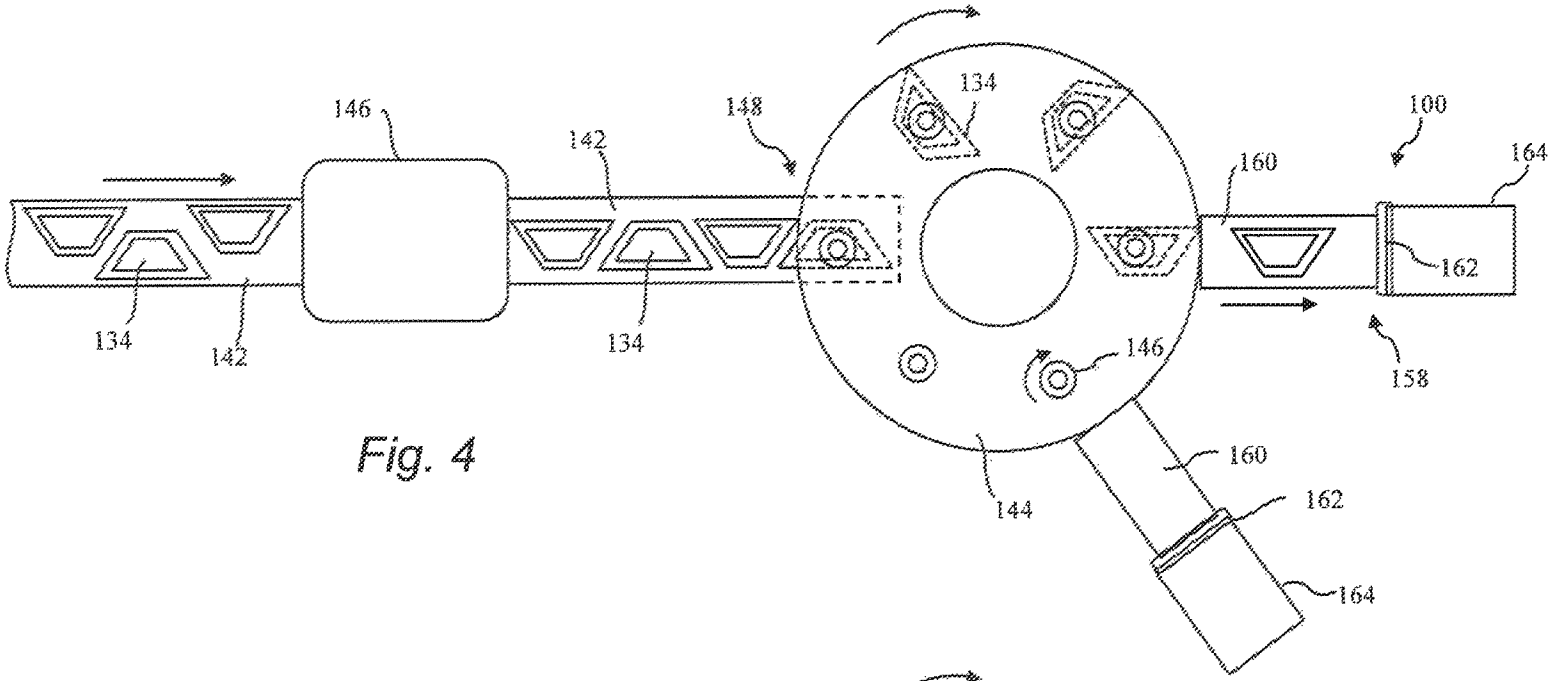
FIG. 4 is a schematic representation of aspects in accordance with the present invention for stacking and loading facemasks into a carton in a production line.

Referring to the embodiment of FIG. 4, individual wrapped facemasks 134 are conveyed by a conveyor 142 in a continuous stream to a delivery location 148. A rotary wheel conveyor 144 is operationally disposed at the delivery location 148 and includes a plurality of individual pick-up devices 146 spaced around a circumference thereof. Various types of pick-up devices 146 are well known in the article conveying industry, and any one or combination of such conventional devices may be used with the current method 100. For example, the pick-up devices 146 may be vacuum pucks, mechanical graspers, suction devices, and so forth.

As the rotary wheel conveyor 144 rotates by the delivery location 148, each individual wrapped facemask 134 is picked up by a respective pick-up device 146 and is transported by the rotary wheel conveyor 144 to an intermediate linear conveyor 160, which conveys the wrapped facemasks to a stacking station 158 wherein the facemasks 134 are deposited into an accumulator 164 for eventual transfer to a carton, as described in greater detail below.

As depicted in FIG. 4, multiple stacking stations 158 and associated conveyors 160 may be operationally disposed around the periphery of the rotary wheel conveyor 144. With this configuration, multiple stations 158 can be serviced at the same time by the same rotary wheel conveyor 144. One station 158 may have a different load size requirement (e.g., different sized carton) as compared to an adjacent station 158. The stations 158 can be simultaneously filled in an alternating process from the same rotary wheel conveyor 144, particularly if the upstream processing speed for production of the masks 134 and speed of the rotary wheel conveyor 144 exceeds the loading rate of a single conveyor 160 and associated accumulator 164.

Figure 5:
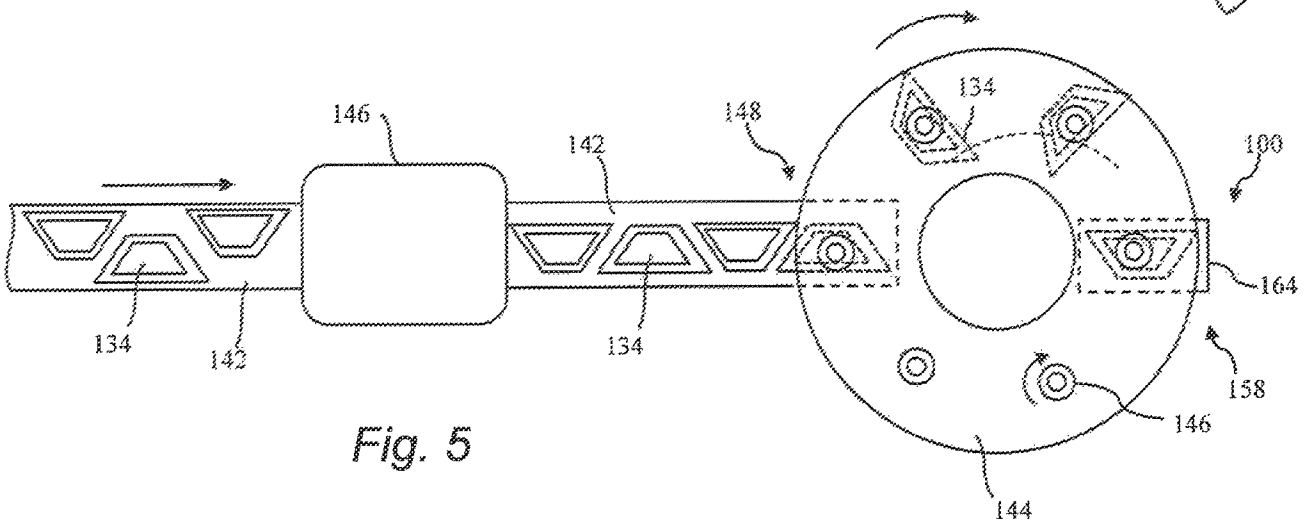
FIG. 5 is a schematic representation of aspects in accordance with the present invention for stacking and loading facemasks into a carton in a production line.

The embodiment of FIG. 5 is similar to that of FIG. 4 except that the wrapped facemasks are deposited directly from the pick-up devices 146 into the accumulator 164. As the rotary wheel conveyor 144 indexes to the stacking location 158, the pucks 146 are controlled to release the facemasks, which fall directly or are guided into the accumulator 164. As with FIG. 4, this embodiment may have multiple stacking locations configured around the periphery of the rotary wheel conveyor 144.

FIGS. 6A through 6D show an operational sequence of one embodiment of the method 100 according to the invention. The method includes conveying individual wrapped facemasks 134 in a continuous stream to the stacking location 158. In the embodiment depicted in FIG. 6A, the facemasks 134 are conveyed by the rotary conveyor 144 and dropped by the puck 146 onto the intermediate linear conveyor 160, as discussed above with respect to FIG. 4. At the stacking location 158, the facemasks 134 are deposited into a vertical accumulator 164 such that the facemasks 134 are stacked in the accumulator 164. The accumulator 164 may be a column or box-like structure having vertical walls 165 and an open top end and an open bottom end.

It may be desired that the facemasks 134 have an alternating stack pattern in the final carton. Thus, the method 100 includes depositing the facemasks 134 into the accumulator 164 in an alternating configuration. For this, the facemasks 134 may be oriented on the conveyor 166, 144 prior to reaching the stacking location 158, for example by a vacuum puck placer or other article moving device.

Figure 6A:
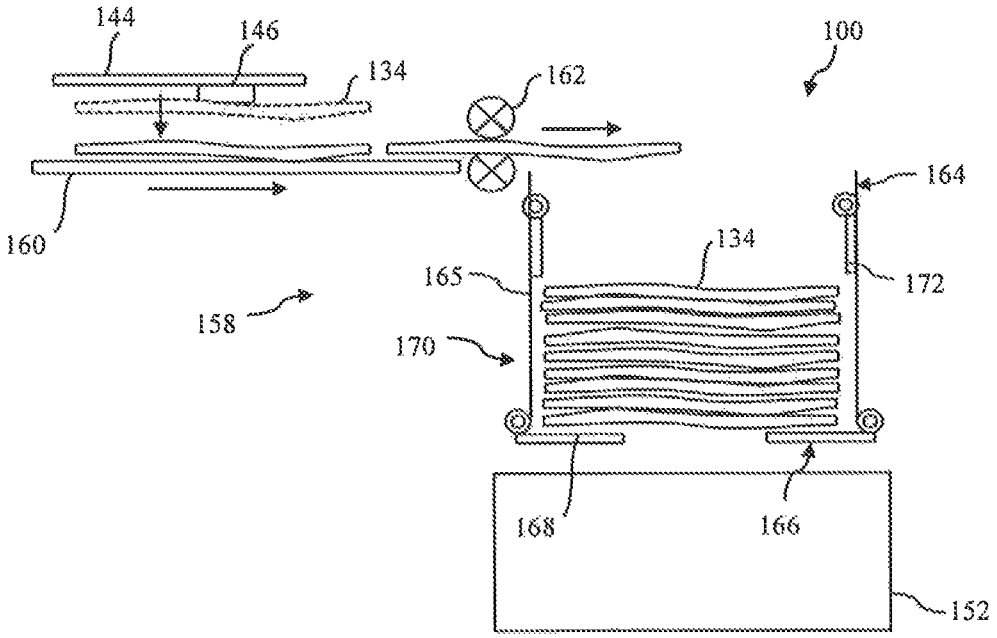
FIGS. 6A through 6D are sequential representations in accordance with the present invention for stacking and loading facemasks into a carton in a production line.

Referring to FIG. 6A, the facemasks 134 continue to be deposited into the accumulator 164 until a predetermined fill level of facemasks 134 in the accumulator 164 is determined by a sensor, counter, or other automated means. FIG. 6A depicts a full load of facemasks 134 in the accumulator 164. A bottom retainer 166 holds the facemasks 134 in the accumulator. This retainer 116 may be any type of flap, floor, side wall, or bottom that can be actuated to a position that allows the facemasks to fall through an open bottom or be pushed out a side wall of the accumulator 164 and into a carton 152 placed below or beside the accumulator 164. In the depicted embodiment, the retainer 166 is a bottom retainer depicted as a pair of flaps 168 that extend at least partially across the open bottom of the accumulator 164 in a closed state, and swing to vertical position in an open state to release the facemasks 134.

Figure 6B:
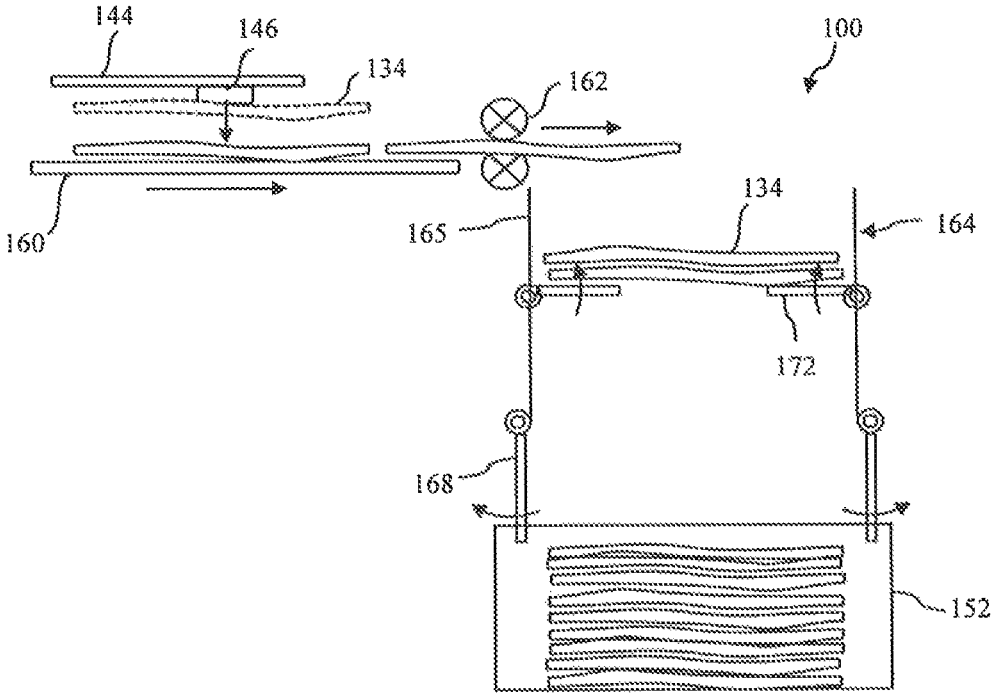

Referring to FIG. 6B, once the full load of facemasks 134 has been deposited into the accumulator 164, the bottom retainer 168 is opened such that the stacked facemasks 134 drop into the carton 152 placed below the accumulator 164. At essentially the same time, a mid-level retainer 170 in the accumulator 164 is actuated to a closed position at an intermediate height above the bottom retainer 166 so as to project into the accumulator 164 and temporarily capture the facemasks 134 that continue to be deposited into the accumulator 164 while the bottom retainer 166 is open. As with the bottom retainer 166, the mid-level retainer 170 may be any manner of controllable flaps, panel, wall, or the like. In the illustrated embodiment, the mid-level retainer 170 is a pair of controllable flaps that are actuated from vertical position within the accumulator 164 (FIG. 6A) to an essentially horizontal position (FIG. 6B) to capture the facemasks at the intermediate height.

Figure 6C:
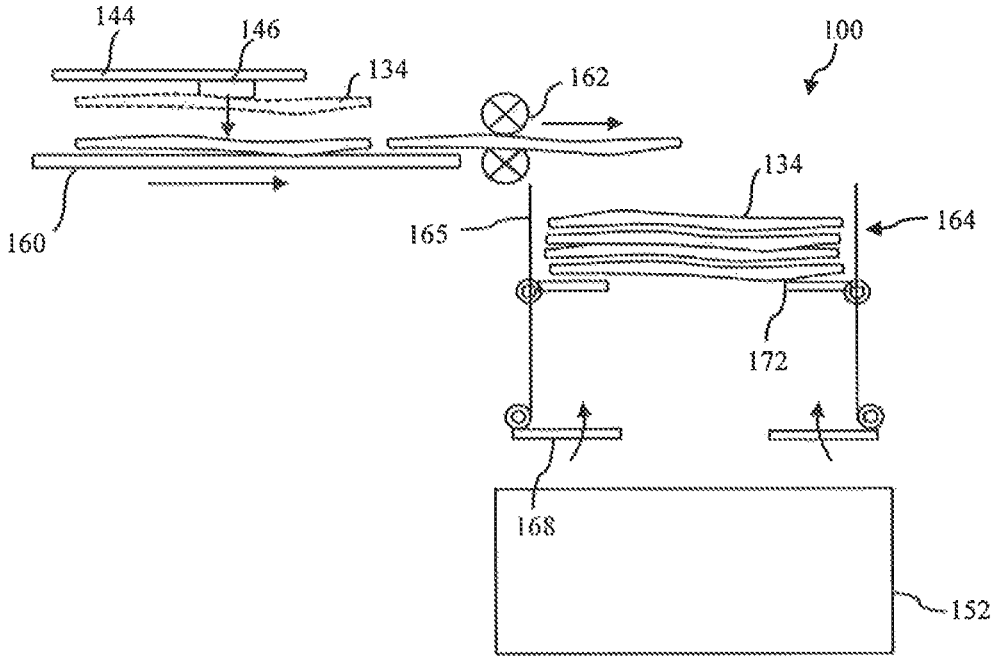

Referring to FIG. 6C, the bottom retainer 166 is closed after the stacked facemasks 134 drop into the carton (FIG. 6*b*). At or about the same time, the mid-level retainer 170 opened such that the facemasks 134 captured by the mid-level retainer 170 drop onto the bottom retainer 166, as depicted in FIG. 6D.

Figure 6D:
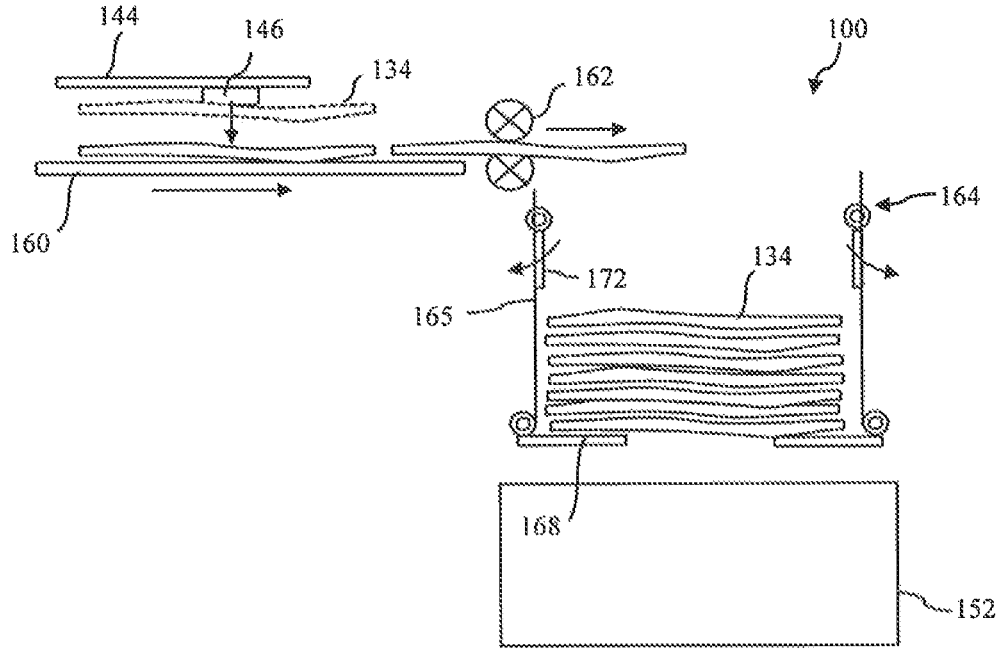

The method 100 may further include staging a second carton 152 below the accumulator 164 after the bottom retainer 166 has closed, as depicted in FIG. 6D, wherein the process is repeated in a continuous manner.

Referring again to FIG. 4 and FIG. 6A, the facemasks 134 may be brought to the stacking location 158 and deposited into the accumulator by a linear conveyor 160 that conveys the continuous stream of facemasks 134 at a certain transport speed to the accumulator 164. This transport speed, however, may be too great for depositing the facemasks 134 directly into the accumulator without causing damage to the wrapped facemasks 134 (including cosmetic damage to the wrapping material) resulting from the facemasks being "launched" and hitting the opposite accumulator wall 165. The method 100 may include slowing the transport speed of the facemasks 134 with a braking device prior to deposition of the facemasks into the accumulator 134. This braking may be accomplished by various means. For example, a pair of controllable feed rollers 162 may "grab" the facemasks 134 from the linear conveyor 160 and decelerate the articles to a slower speed prior to the facemasks 134 dropping into the accumulator 164.

The present method 100 provides increased versatility in that different carton sizes and load requirements can be met by changing the predetermined fill level of facemasks in the accumulator 164 to accommodate the different carton sizes.

It should be appreciated that the methods and systems described herein are not limited to stacking and loading wrapped facemasks. The present invention is just as applicable to stacking and loading unwrapped facemasks. Although the embodiments described herein relate to wrapped facemasks, it is intended that the invention encompass the same methods and systems for stacking and loading unwrapped facemasks. For example, in the embodiment of FIG. 4, unwrapped facemasks could be conveyed by conveyor 142 to the rotary conveyor 144, and then processed as described herein.

As mentioned, the present invention also encompasses various system embodiments for automated stacking and loading facemasks into a carton in a facemask production line in accordance with the present methods. Aspects of such systems are illustrated in the figures, and described and supported above.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. An automated method for stacking and loading facemasks into a carton in a facemask production line, comprising:

conveying individual facemasks in a continuous stream to a stacking location;

at the stacking location, depositing the facemasks into a vertical accumulator such that the facemasks are initially stacked in the accumulator atop a bottom retainer in the accumulator until a predetermined fill level of the facemasks constituting a carton of the facemasks are accumulated atop the bottom retainer;

upon reaching the predetermined fill level of the initially stacked facemasks atop the bottom retainer in the accumulator, opening the bottom retainer such that the stacked facemasks drop into a carton placed below the accumulator, the bottom retainer at a fixed height in the accumulator such that the stacked facemasks drop from the fixed height at which they were stacked on the bottom retainer into the carton;

upon opening the bottom retainer, continuing to deposit the facemasks into the accumulator and actuating a mid-level retainer in the accumulator that captures the facemasks that continue to be deposited into the accumulator at an intermediate height above the bottom retainer, the mid-level retainer at a fixed height in the accumulator; and closing the bottom retainer after the stacked facemasks drop into the carton, and then opening the mid-level retainer such that the facemasks captured by the mid-level retainer drop from the fixed height at which the facemasks were deposited on the mid-level retainer onto the bottom retainer.

2. The method as in claim 1, further comprising staging a second carton below the accumulator after the bottom retainer has closed, and repeating the method.

3. The method as in claim 1, wherein a conveyance speed of the facemasks is slowed prior to the facemask being deposited into the accumulator.

4. The method as in claim 3, wherein the facemasks are deposited from a conveyor into the accumulator by feed rollers, the method further comprising slowing the conveyance speed of the facemasks with the feed rollers prior to the facemasks being deposited into the accumulator.

5. The method as in claim 1, wherein the facemasks are deposited into the accumulator in an alternating configuration.

6. The method as in claim 1, further comprising changing the predetermined fill level of facemasks in the accumulator to accommodate different carton sizes.

7. The method as in claim 6, wherein the facemasks are conveyed to the stacking location by a linear conveyor.

8. The method as in claim 1, wherein the facemasks are conveyed to the stacking by a rotary vacuum conveyor and released from the vacuum conveyor above the accumulator.

9. The method as in claim 1, wherein the facemasks are individually wrapped prior to reaching the stacking location.

10. A system for stacking and loading facemasks into a carton in a facemask production line, wherein the system is specifically configured to practice the method of claim 1.

* * * * *